US012716344B2

(12) United States Patent
Wu et al.

(10) Patent No.: US 12,716,344 B2
(45) Date of Patent: Aug. 25, 2026

(54) BOREHOLE CORRECTION FOR RESISTIVITY LWD TOOLS WITH ULTRASONIC LOG WHILE DRILLING CALIPER

(71) Applicant: Halliburton Energy Services, Inc., Houston, TX (US)

(72) Inventors: Xiang Wu, Singapore (SG); Yi Jing Fan, Singapore (SG); Jing Jin, Singapore (SG)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 761 days.

(21) Appl. No.: 17/952,844

(22) Filed: Sep. 26, 2022

(65) Prior Publication Data

US 2024/0102374 A1 Mar. 28, 2024

(51) Int. Cl.
*E21B 44/00* (2006.01)
*E21B 47/0228* (2012.01)
(Continued)

(52) U.S. Cl.
CPC ..... *E21B 44/00* (2013.01); *E21B 47/0228* (2020.05); *E21B 47/085* (2020.05); *E21B 49/005* (2013.01); *E21B 2200/20* (2020.05)

(58) Field of Classification Search
CPC .... E21B 44/00; E21B 47/0228; E21B 47/085; E21B 47/14; E21B 49/00; E21B 49/005;
(Continued)

(56) References Cited

U.S. PATENT DOCUMENTS 3,590,940 A * 7/1971 Leger ..... E21B 47/085 73/152.16
5,900,733 A 5/1999 Wu et al.
(Continued)

FOREIGN PATENT DOCUMENTS

WO 2016137500 A1 9/2016
WO 2020159484 A1 8/2020

OTHER PUBLICATIONS

Zhao, Peiqiang, and et al. "Study on array laterolog response simulation and mud-filtrate invasion correction." Advances in Geo-Energy Research 3, No. 2 (2019): 175-186 (Year: 2019).*
(Continued)

*Primary Examiner* — Douglas Kay
(74) *Attorney, Agent, or Firm* — NOVAK DRUCE CARROLL LLP

(57) ABSTRACT

Aspects of the subject technology relate to systems, methods, and computer-readable media for identifying a borehole correction factor which is used for determining a true resistivity by selecting a model and applying the model to an apparent resistivity to identify the borehole correction factor. To determine the borehole correction factor, a multiplicative coefficient is needed corresponding to the apparent resistivity. A database of this multiplicative coefficient, called the borehole correction factor, is generated based on the borehole's varying diameter effect correction model. The technology described herein allows operators to avoid time-consuming variable borehole diameter sweeps and complex borehole diameter inversion currently used in resistivity logging software.

20 Claims, 12 Drawing Sheets

(51) Int. Cl.
*E21B 47/085* (2012.01)
*E21B 49/00* (2006.01)

(58) Field of Classification Search
CPC .... E21B 2200/20; E21B 2200/22; E21B 7/04; G01V 1/40; G01V 2200/16
See application file for complete search history.

(56) References Cited

U.S. PATENT DOCUMENTS

| | | | | |
|---|---|---|---|---|
| 9,971,058 | B2 * | 5/2018 | San Martin | G01V 9/00 |
| 10,520,639 | B2 * | 12/2019 | Yang | G01V 11/00 |
| 2012/0166086 | A1 * | 6/2012 | Zhong | E21B 49/00 702/7 |
| 2015/0315904 | A1 * | 11/2015 | Manclossi | E21B 47/085 702/9 |
| 2015/0369037 | A1 | 12/2015 | Jones | |
| 2018/0003853 | A1 * | 1/2018 | Ewe | G01V 3/28 |
| 2018/0017701 | A1 * | 1/2018 | San Martin | E21B 44/00 |
| 2021/0256671 | A1 * | 8/2021 | Guner | G06T 5/50 |
| 2021/0277773 | A1 * | 9/2021 | Fan | E21B 47/12 |
| 2023/0203933 | A1 * | 6/2023 | Badrinarayanan | E21B 44/02 175/45 |

OTHER PUBLICATIONS

Doetsch, Joseph A., Ilaria Coscia, Stewart Greenhalgh, Niklas Linde, Alan Green, and Thomas Günther. "The borehole-fluid effect in electrical resistivity imaging." Geophysics 75, No. 4 (2010): F107-F114) (Year: 2010).*

Abstract of Li, Peng et al., "New 4.75-in. Ultrasonic LWD Technology Provides High-Resolution Caliper and Imaging in Oil-Based and Water-Based Muds," Petrophysics 60 (06): 712-732; SPWLA-2019-v60n6a2; Dec. 1, 2019.

Abstract of Bittar, M. et al., "A New Azimuthal Deep-Reading Resistivity Tool for Geosteering and Advanced Formation Evaluation," SPE Res Eval & Eng 12 (02): 270-279; SPE-109971-PA; Apr. 14, 2009.

Abstract of Ballay, Gene et al., "In the Driver's Seat with LWD Azimuthal Density Images," SPE/IADC Middle East Drilling Technology Conference, Bahrain; SPE-72282-MS; Oct. 22, 2001.

Abstract of Hou, Junsheng et al., "Real-Time Borehole Correction For A New Multicomponent Array Induction Logging Tool In Obm Wells," SPWLA 53rd Annual Logging Symposium, Cartagena, Colombia; SPWLA-2012-076; Jun. 16, 2012.

International Search Report & Written Opinion; PCT Application No. PCT/US2023/021653; mailed Sep. 4, 2023.

Zhao et al., Study on array laterolog response simulation and mud-filtrate invasion correction, Advances in Geo-Energy Research, Mar. 10, 2019, vol. 3, pp. 175-186 X pp. 183, 185.

* cited by examiner

BOREHOLE CORRECTION FOR RESISTIVITY LWD TOOLS WITH ULTRASONIC LOG WHILE DRILLING CALIPER

TECHNICAL FIELD

The present technology pertains to identifying a borehole correction factor for determining a true resistivity, and more particularly to selecting a model to apply in identifying the borehole correction factor and applying the model to an apparent resistivity to identify the borehole correction factor.

BACKGROUND

Borehole effect is a problem that can be encountered by Logging While Drilling (herein "LWD") tools when attempting to measure the true resistivity of a formation. The value of the borehole effect is determined using both the borehole diameter as well as the mud resistivity. Borehole correction techniques can be applied to overcome the borehole effect and determine the true resistivity of the formation. However, various problems are associated with applied borehole correction techniques.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
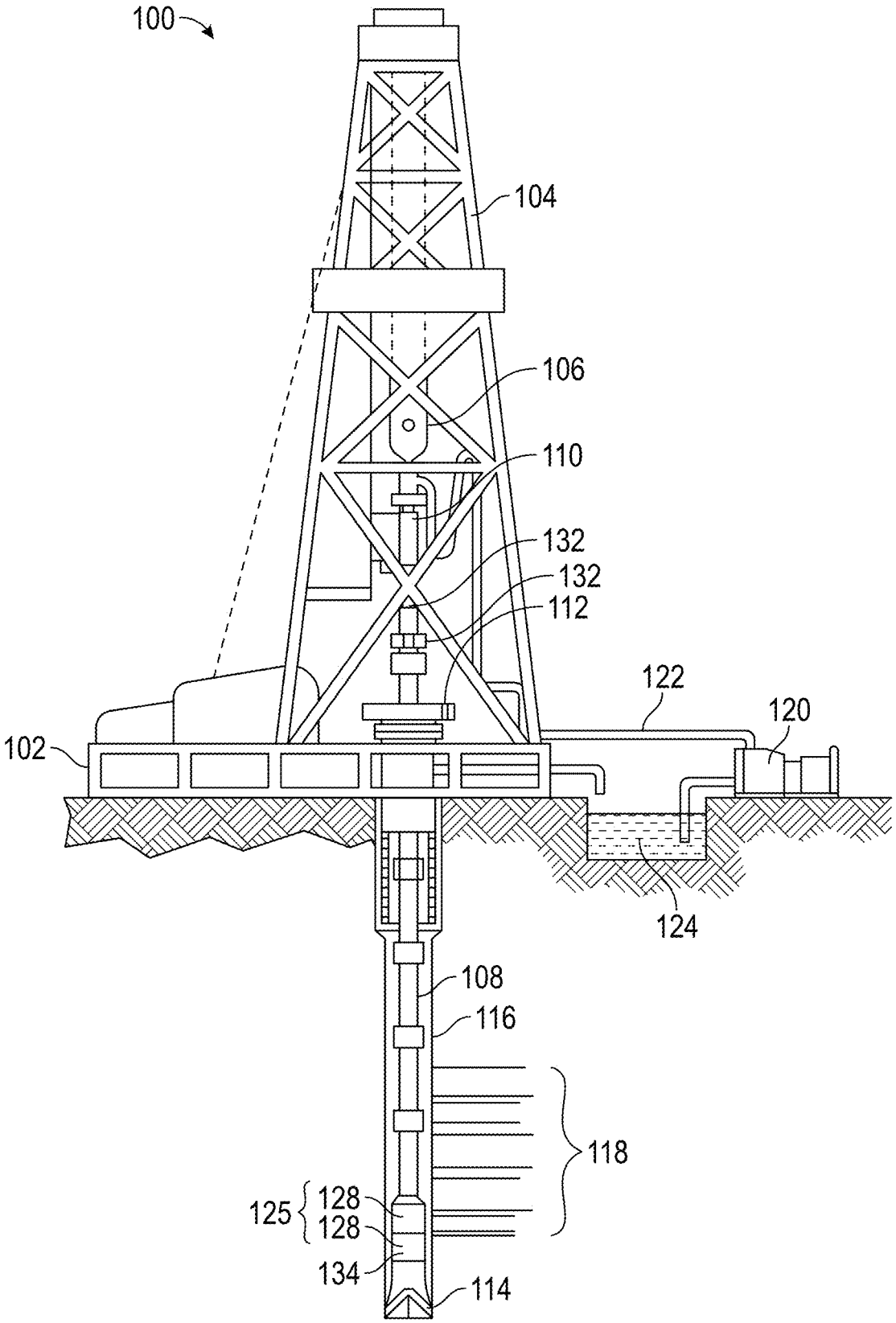
FIG. 1A is a schematic diagram of an example logging while drilling wellbore operating environment, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

As discussed previously, borehole effect is a problem that can be encountered by Logging While Drilling (herein "LWD") tools when attempting to measure the true resistivity of a formation. The value of the borehole effect is determined using both the borehole diameter as well as the mud resistivity. Borehole correction techniques can be applied to overcome the borehole effect and determine the true resistivity of the formation. However, various problems are associated with applied borehole correction techniques.

One such borehole correction technique can employ the use of a database comprising borehole correction factors that have been previously simulated for a full range of various borehole diameters and mud resistivities. In field tests, the apparent resistivity can be used to interpolate the database with the estimated borehole diameter and the mud resistivity to obtain the borehole correction factor (herein "BHC").

A LWD caliper measurement may be used to measure the borehole diameter at each depth point. These measured borehole diameter values can be subsequently used as inputs for the borehole correction. Although some LWD electric calipers and density calipers has been introduced before, these calipers can be designed to work in either water-based mud or oil-based mud borehole conditions. In addition, the resolution can be generally poor and does not provide reliable borehole sizes. Due to various uncertainties associated with estimating the borehole diameter, a variable borehole scheme may be used for some of the resistivity tool.

A BHC algorithm can be used that sweeps through a series of borehole diameters ranging between the expected minimum and expected maximum of borehole sizes. Upon analysis, the borehole diameter that yields the best curve stacking is selected as the estimated borehole diameter. This technique requires high costs and substantial time thereby preventing real-time implementation. Other known resistivity tools can use an inversion method to convert borehole diameter and true resistivity together that increases the system complexity and ambiguity. And, further, reduces the reliability and accuracy of the resistivity log result. Additionally, this variable borehole scheme may lead to other problems such as potentially mistaking invasion effect for borehole effect. An ultrasonic LWD tool, however, is able to provide high resolution caliper information in both water-based mud and oil-based mud. The ultrasonic LWD tool is capable of being used in conjunction with LWD resistivity tools to provide real-time high resolution caliper data for high accuracy borehole correction.

The disclosed technology addresses the foregoing by using a caliper to provide borehole size information to a resistivity LWD tool for borehole correction. An ultrasonic caliper is different than either electric or density calipers since it is capable of providing high resolution caliper information in both water-based mud and oil-based mud. Therefore, it can provide reliable caliper data in various drilling environments. It can also be used in conjunction with LWD resistivity tools to provide high resolution caliper data for high accuracy borehole correction.

The technology described herein allows operators to avoid time-consuming variable borehole diameter sweeps and complex borehole diameter inversion current used in resistivity logging software. Additionally, it enables real-time implementation of BHC and enhances the accuracy of the real-time resistivity logs. Essentially, it assists operators in making fast and correct geosteering decisions during LWD operations.

Turning now to FIG. 1A, a drilling arrangement is shown that exemplifies a Logging While Drilling (commonly abbreviated as LWD) configuration in a wellbore drilling scenario 100. Logging-While-Drilling typically incorporates sensors that acquire formation data. Specifically, the drilling arrangement shown in FIG. 1A can be used to gather formation data through an electromagnetic imager tool as part of logging the wellbore using the electromagnetic imager tool. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the both drill bit 114 extends into the wellbore 116 through the formations 118 and as the drill string 108 is pulled out of the wellbore 116, logging tools 126 collect measurements relating to various formation properties as well as the orientation of the tool and various other drilling conditions. The logging tool 126 can be applicable tools for collecting measurements in a drilling scenario, such as the electromagnetic imager tools described herein. Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

The bottom-hole assembly 125 may also include a telemetry sub 128 to transfer measurement data to a surface receiver 132 and to receive commands from the surface. In at least some cases, the telemetry sub 128 communicates with a surface receiver 132 by wireless signal transmission. e.g, using mud pulse telemetry, EM telemetry, or acoustic telemetry. In other cases, one or more of the logging tools 126 may communicate with a surface receiver 132 by a wire, such as wired drill pipe. In some instances, the telemetry sub 128 does not communicate with the surface, but rather stores logging data for later retrieval at the surface when the logging assembly is recovered. In at least some cases, one or more of the logging tools 126 may receive electrical power from a wire that extends to the surface, including wires extending through a wired drill pipe. In other cases, power is provided from one or more batteries or via power generated downhole.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
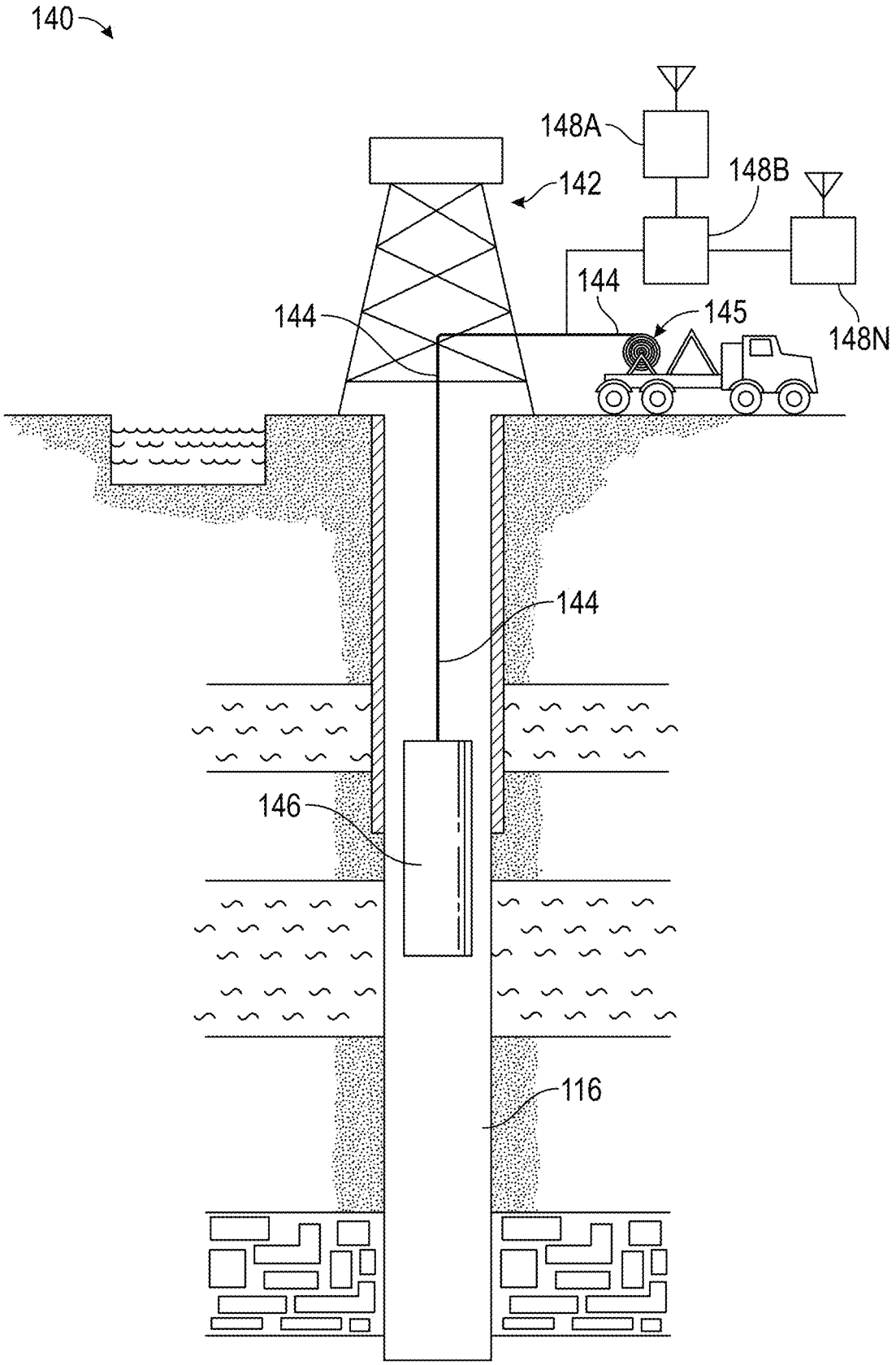
FIG. 1B is a schematic diagram of an example downhole environment having tubulars, in accordance with various aspects of the subject technology.

Referring to FIG. 1B, an example system 140 is depicted for conducting downhole measurements after at least a portion of a wellbore has been drilled and the drill string removed from the well. An electromagnetic imager tool can be operated in the example system 140 shown in FIG. 1B to log the wellbore. A downhole tool is shown having a tool body 146 in order to carry out logging and/or other operations. For example, instead of using the drill string 108 of FIG. 1A to lower the downhole tool, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars. The downhole tool can include an applicable tool for collecting measurements in a drilling scenario, such as the electromagnetic imager tools described herein.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. The processors 148A-N can be integrated as part of an applicable computing system, such as the computing device architectures described herein. Moreover, power can be supplied via the wireline conveyance 144 to meet power requirements of the tool. For slickline or coiled tubing configurations, power can be supplied downhole with a battery or via a downhole generator.

Figure 2:
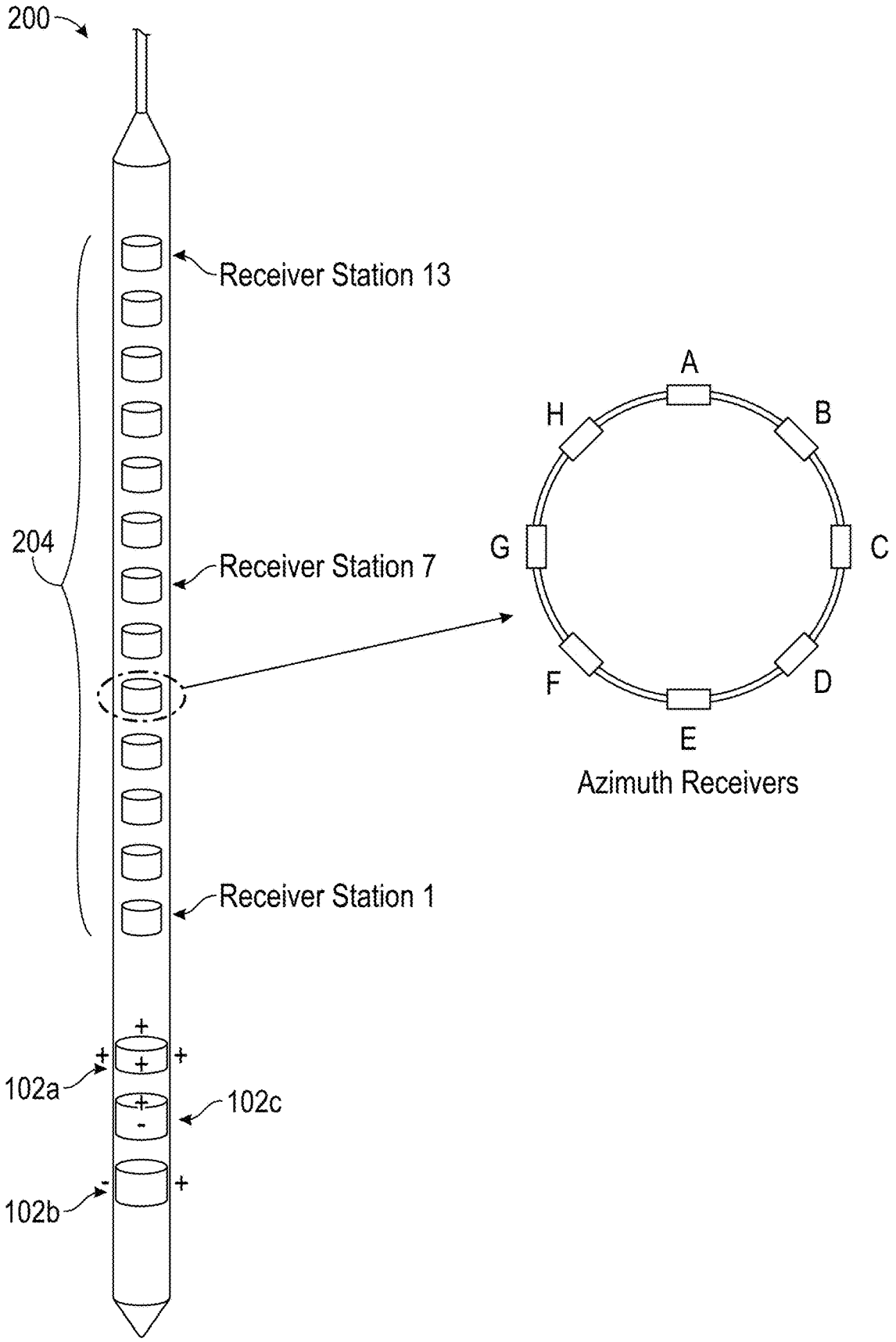
FIG. 2 illustrates an acoustic tool which may be used to perform certain illustrative methods of the present disclosure.

FIG. 2 illustrates an acoustic tool which may be used to perform certain illustrative methods of the present disclosure. Acoustic logging tool 100 includes multiple transmitters 102 to excite different borehole modes and a receiver array section 104 that captures borehole acoustic waves of different azimuthal orders. Transmitters 102 include a monopole source 102 *a*, Y dipole source 102 *b*, and an X dipole source 102 *c*. Ultimately, the methods described herein may be applied in any variety of azimuthal receiver arrays or other receiver configurations. In addition, tool 100 may also include cross dipole sources, specifically X source or Y source, so that the methods described herein may be applied either in X dipole data or Y dipole data.

Figure 3:
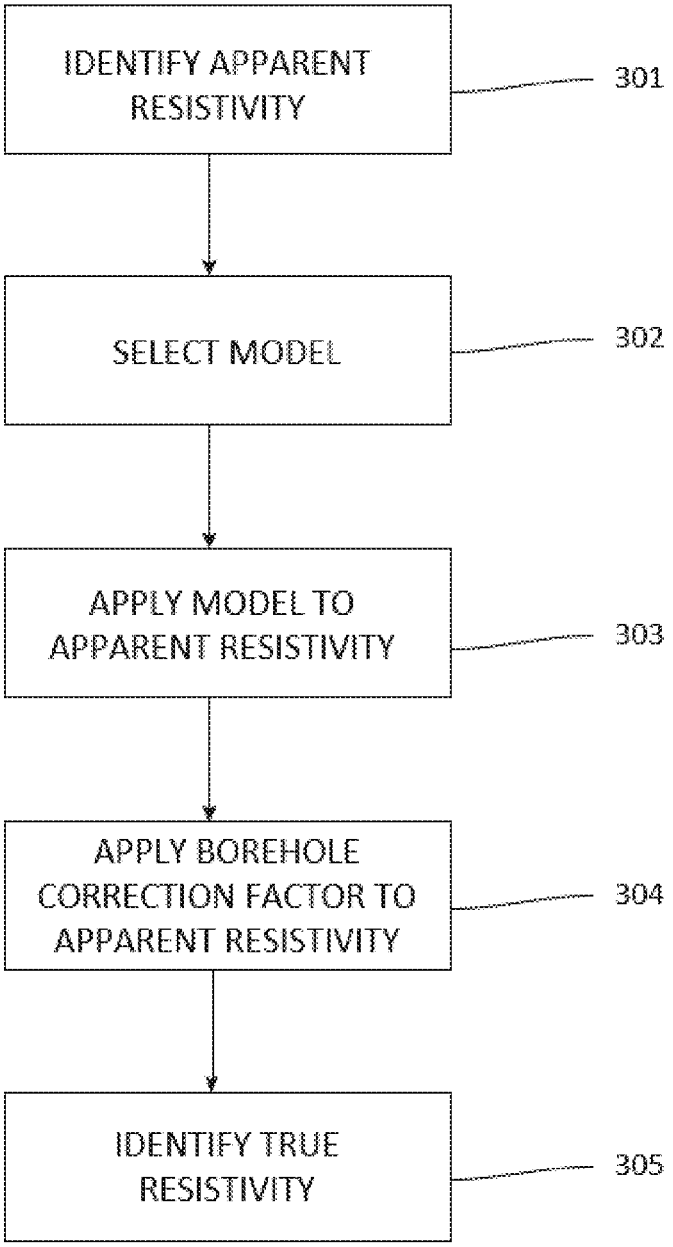
FIG. 3 illustrates a flowchart for an example method for determining a true resistivity of the formation by applying a borehole correction factor to an apparent resistivity.

FIG. 3 illustrates a flowchart for an example method for determining a true resistivity of the formation by applying a borehole correction factor to an apparent resistivity. The method shown in FIG. 3 is provided by way of example, as there are a variety of ways to carry out the method. Additionally, while the example method is illustrated with a particular order of steps, those of ordinary skill in the art will appreciate that FIG. 3 and the modules shown therein can be executed in any order and can include fewer or more modules than illustrated. Each module shown in FIG. 3 represents one or more steps, processes, methods or routines in the method.

To perform borehole correction, a multiplicative coefficient is needed to apply to the apparent resistivity. A database of this multiplicative coefficient, called the borehole correction factor, is generated based on the borehole correction model. The borehole correction model assumes two cylindrical layers, one is borehole and the other is the formation. At step 301, an apparent resistivity associated with a formation surrounding the borehole is identified from the measurement data. From the borehole diameter and mud resistivity, the simulated signal with borehole can be used to derive apparent resistivity.

At step 302, a borehole correction model is selected to apply from a plurality of borehole correction models that specify relationships between an apparent resistivity variable and a borehole correction factor variable. Specifically, the model assumes two cylindrical layers, one is borehole and the other is the formation. In some examples, the measurement data can include data related to average borehole diameter of the borehole, eccentricity associated with the borehole, or a combination thereof. In some examples, the model is selected based on at least one of known borehole diameter, eccentricity, known mud resistivity, or a combination thereof.

In some examples, the LWD tool may be an ultrasonic LWD tool configured to operate in both an oil-based mud and a water-based mud. Further, the plurality of models can include a multi-dimensional group of models for various borehole diameters, eccentricities, mud resistivities, or a combination thereof in relation to the borehole correction factor.

At step 303, the model is applied to the apparent resistivity to identify a borehole correction factor. Specifically, the borehole correction factor is obtained by taking the ratio between true resistivity and apparent resistivity. The 3D databased is generated for multiple borehole diameters and mud resistivity. In the real field test, the signal measured signal by the resistivity LWD tool is used to calculate the apparent resistivity. The apparent resistivity will then be used to interpolate the database system with the estimated borehole diameter and the mud resistivity to obtain the borehole correction factor.

At step 304, the borehole correction factor is applied to the apparent resistivity, which determines the true resistivity of the formation as shown in step 305. The ultrasonic LWD tool is able to provide high resolution caliper information in both water-based mud and oil-based mud, and therefore can be used in conjunction with LWD resistivity tools to provide real-time high resolution caliper data for high accuracy borehole correction.

Figure 4A:
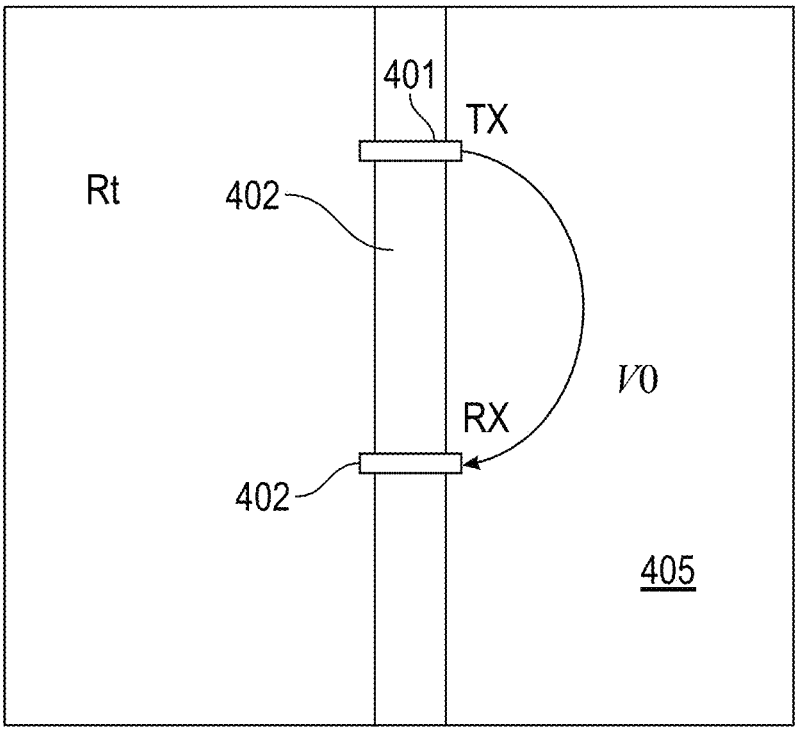
FIG. 4A is a schematic diagram of an example transmitter and receiver combination within a wellbore.
Figure 4B:
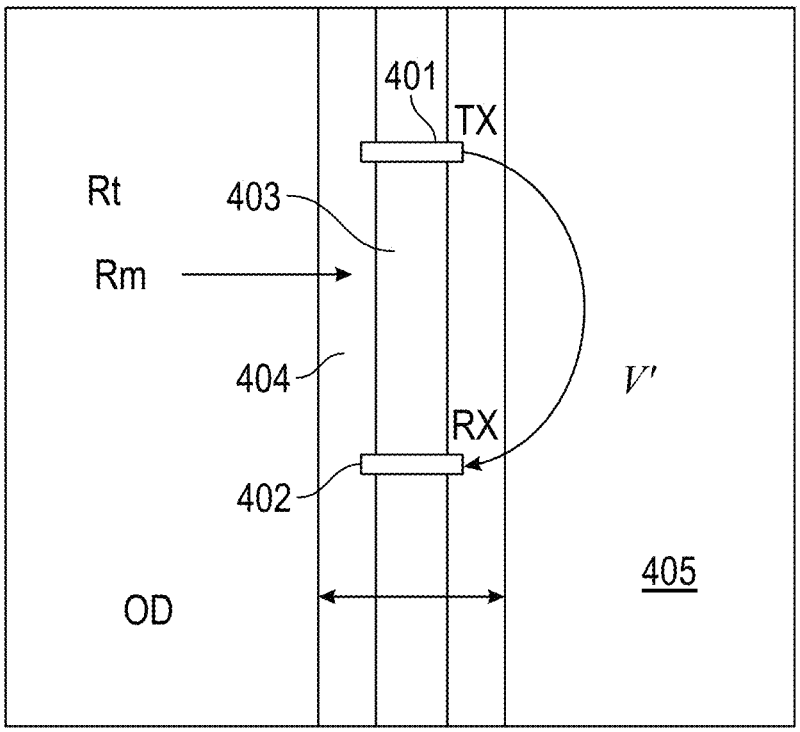
FIG. 4B is a schematic diagram of an alternative example transmitter and receiver combination within a wellbore.
Figure 4C:
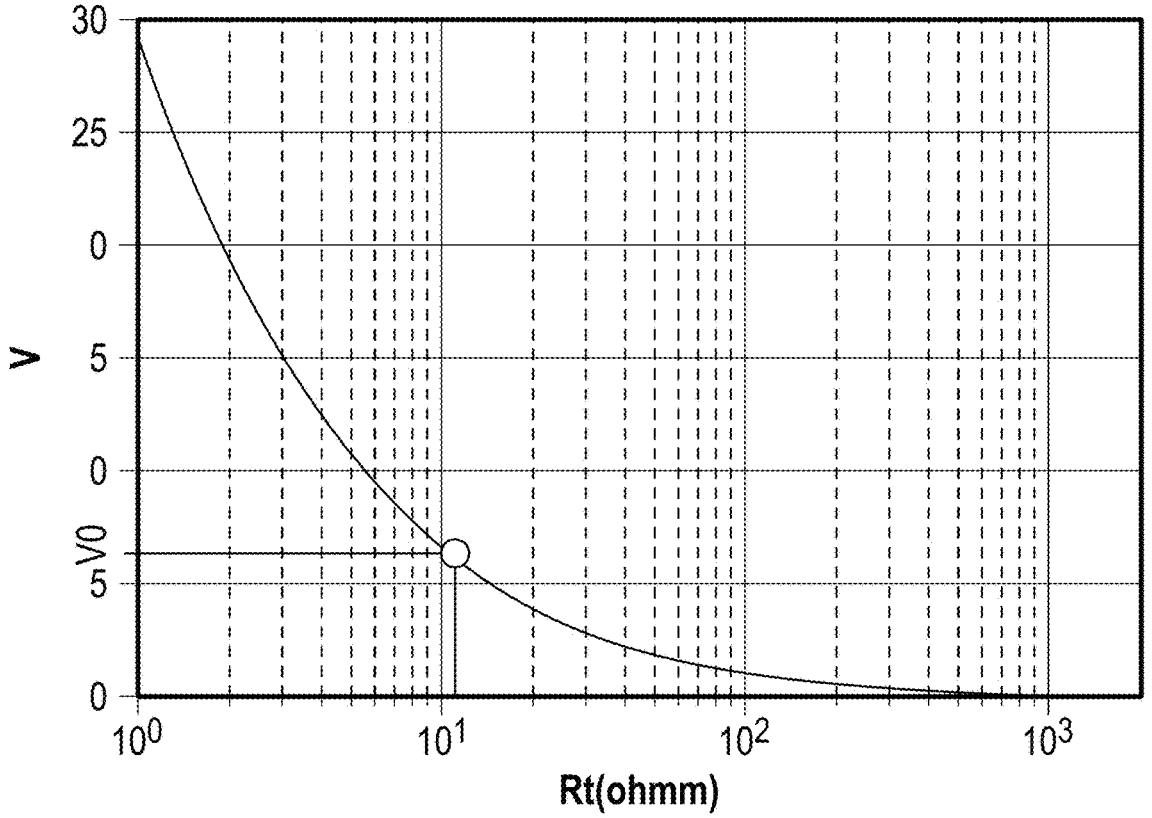
FIG. 4C illustrates a borehole model for generating borehole correction database.
Figure 4D:
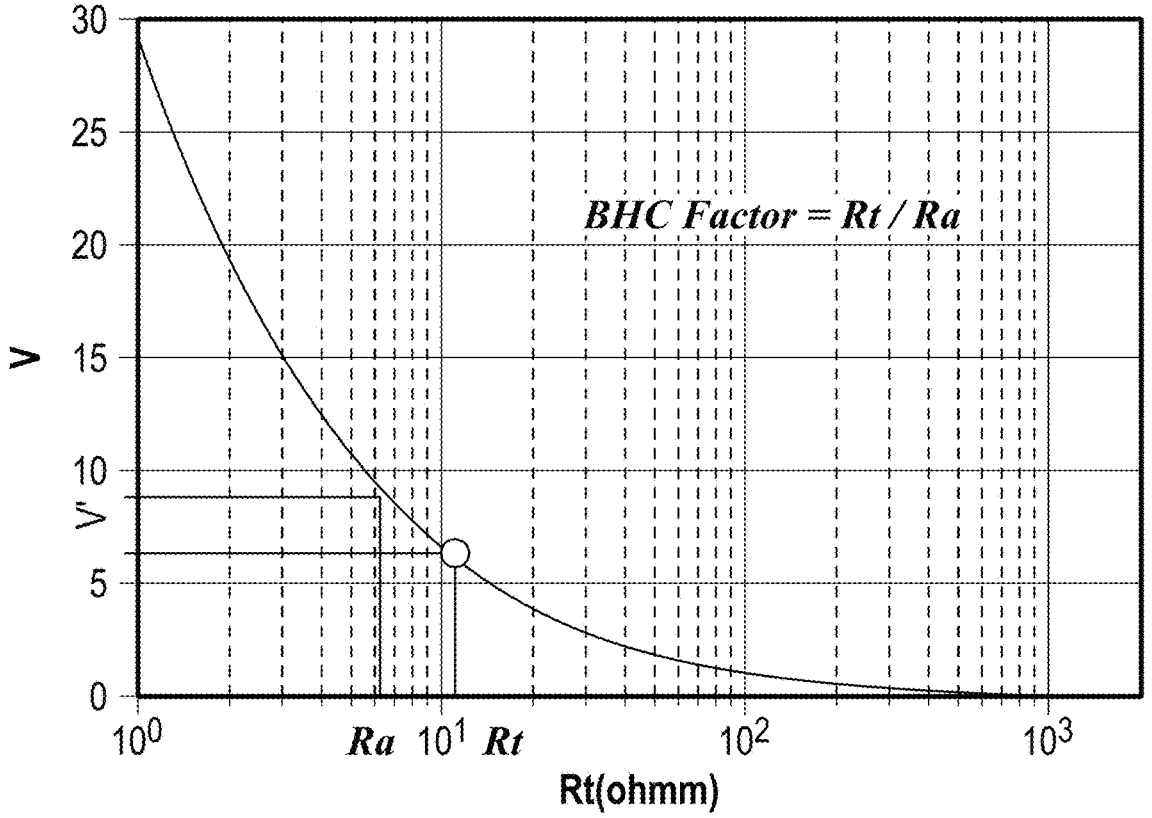
FIG. 4D illustrates an alternative borehole model for generating borehole correction database.

FIGS. 4A-4D illustrate borehole models for generating a borehole correction database. As shown in FIGS. 4A and 4B, the borehole correction model includes two cylindrical layers, the borehole (403 in FIG. 4A, and both 403 and 404 in FIG. 4B) and the other is the formation (405 in both FIGS. 4A and 4B). For known borehole diameter (OD) and mud resistivity (Rm), the simulated signal obtained from transmitting the signal from Tx 401 to Rx 402 may be used to derive the apparent resistivity. The borehole correction factor is obtained by taking the ratio between the true resistivity and this apparent resistivity as shown in FIGS. 4C and 4D. In operation, the signal measured by the resistivity LWD tool is used to calculate the apparent resistivity. The apparent resistivity can subsequently be used to interpolate the database system with estimated borehole diameter (OD) and mud resistivity (Rm) to obtain the borehole correction factor.

Figure 5:
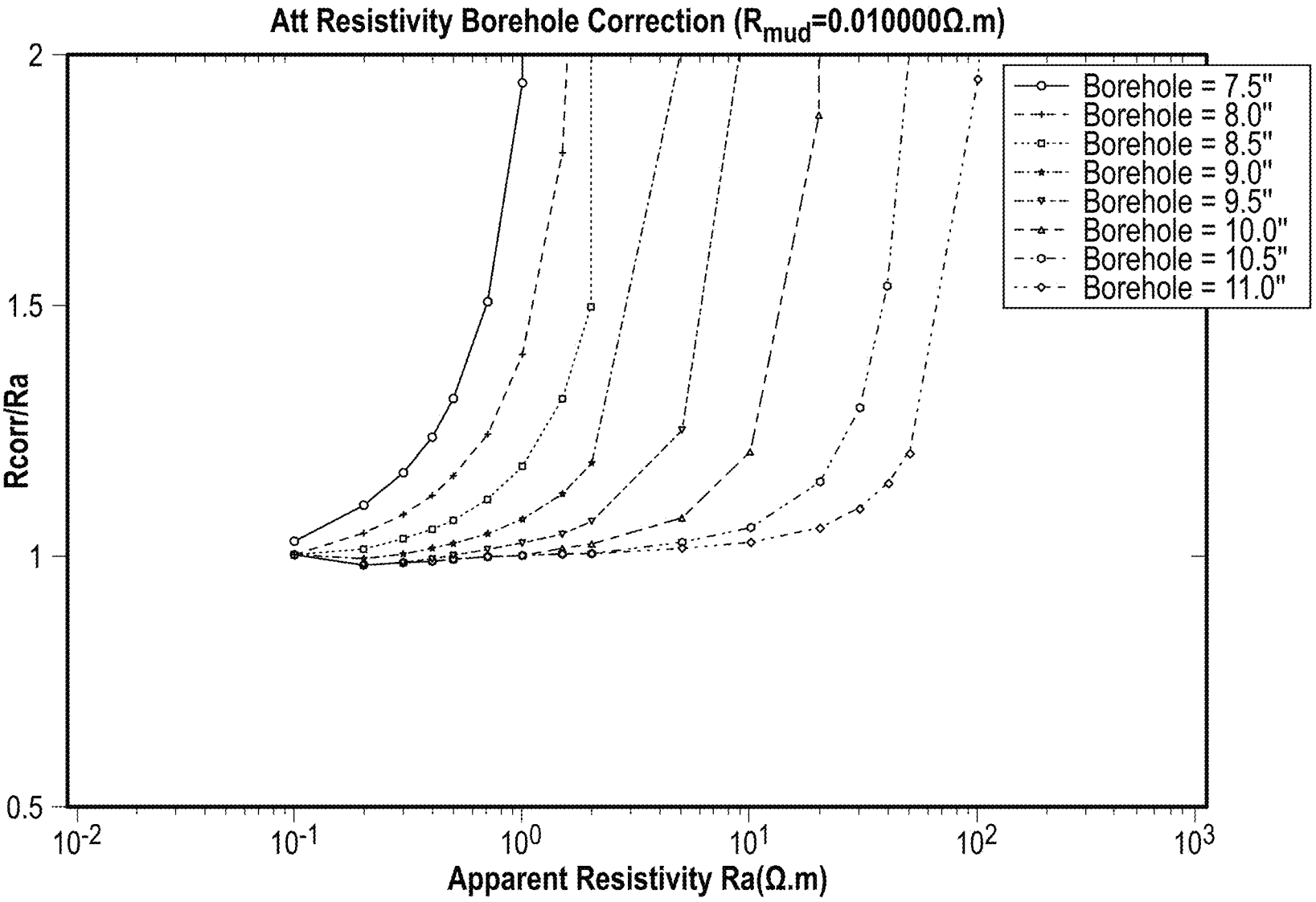
FIG. 5 illustrates a 2D graphical representation of a 4D borehole correction database.
Figure 6:
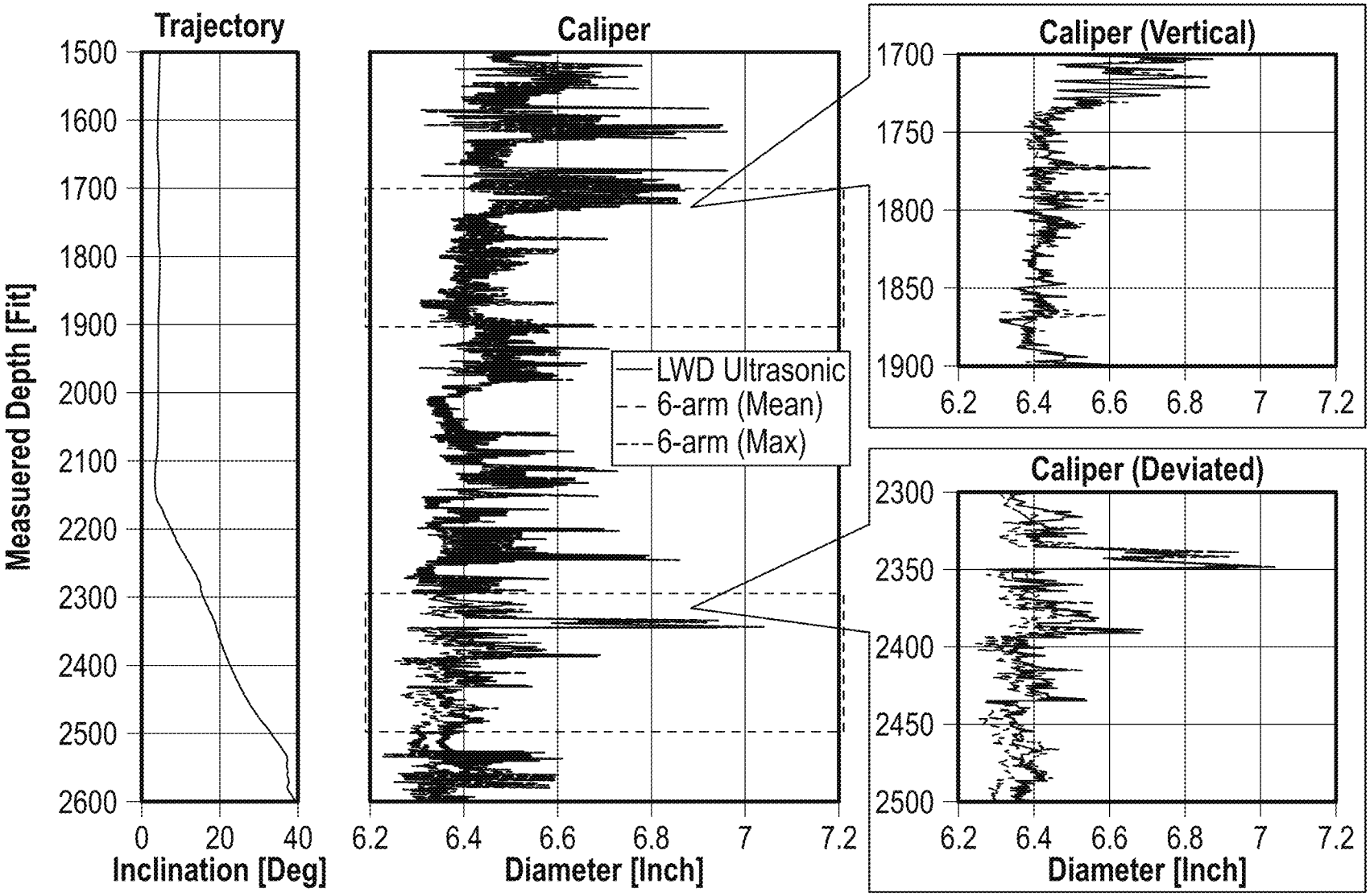
FIG. 6 illustrates a graphical representation of a comparison of LWD caliper and wireline six-arm caliper data.

FIG. 5 illustrates a 2D graphical representation of a 4D borehole correction database under a fixed set, wherein Rm, borehole diameter (OD), and Eccentricity=0. As illustrated in FIG. 5, Rcorr corresponds to the corrected resistivity (which can also be considered the true resistivity), and Att corresponds to the amplitude of one or two receiver voltages. In this example, Rcorr/Ra corresponds to the BHC factor (F). The 4D database can be generated for multiple borehole diameters (OD) and mud resistivity (Rm) as shown in FIG. 5. FIG. 6 illustrates a graphical representation of a comparison of LWD caliper and wireline six-arm caliper data. As shown in FIG. 6, comparison of the LWD caliper data with the average caliper data (obtained from the mean value from each arm) and maximum caliper data (obtained from the maximum value of 180 degree separated pairs of arms) from the multi-finger caliper tool provides a correlation throughout the drilled section. It is noted, that separation between the LWD caliper and the wireline caliper in deviated sections is attributed to the wireline tool not being perfectly centralized within the borehole.

Figure 7:
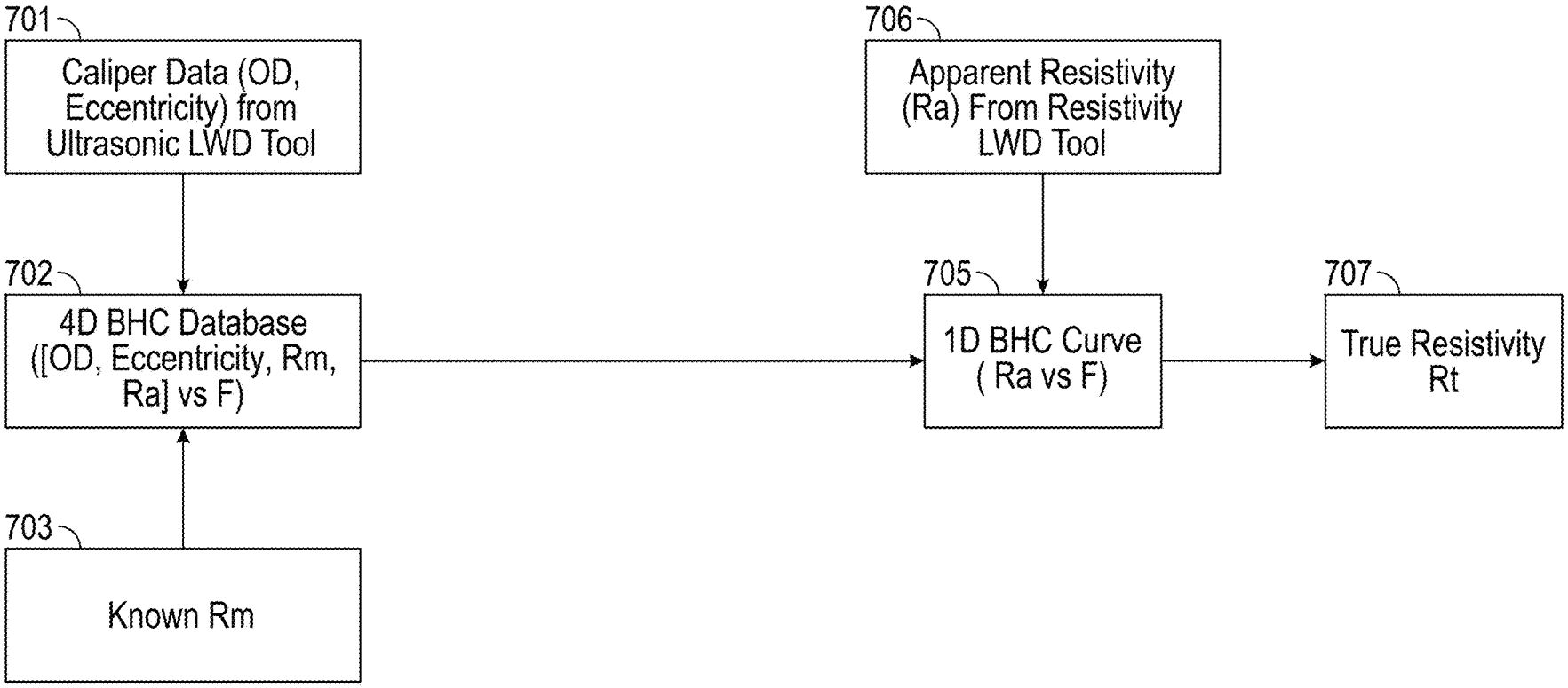
FIG. 7 illustrates a workflow of the borehole correction process for a resistivity LWD tool with ultrasonic LWD caliper data.

FIG. 7 illustrates a workflow of the borehole correction process for a resistivity LWD tool with ultrasonic LWD caliper data. At block 701, an ultrasonic LWD tool is fired to acquire caliper data, including the average borehole diameter (OD) and the eccentricity. 2). At block 702, the measured borehole diameter (OD) and eccentricity is combined with the known mud resistivity (Rm) (block 703) to choose a BHC curve from the 4D resistivity BHC database (FIG. 5). Next, at block 706, resistivity LWD tool us used to acquire the apparent resistivity (Ra) that is used to look up the BHC factor (F) from the BHC curve at block 705 to calculate the true resistivity (Rt=Ra*F) at block 707.

Figure 8:
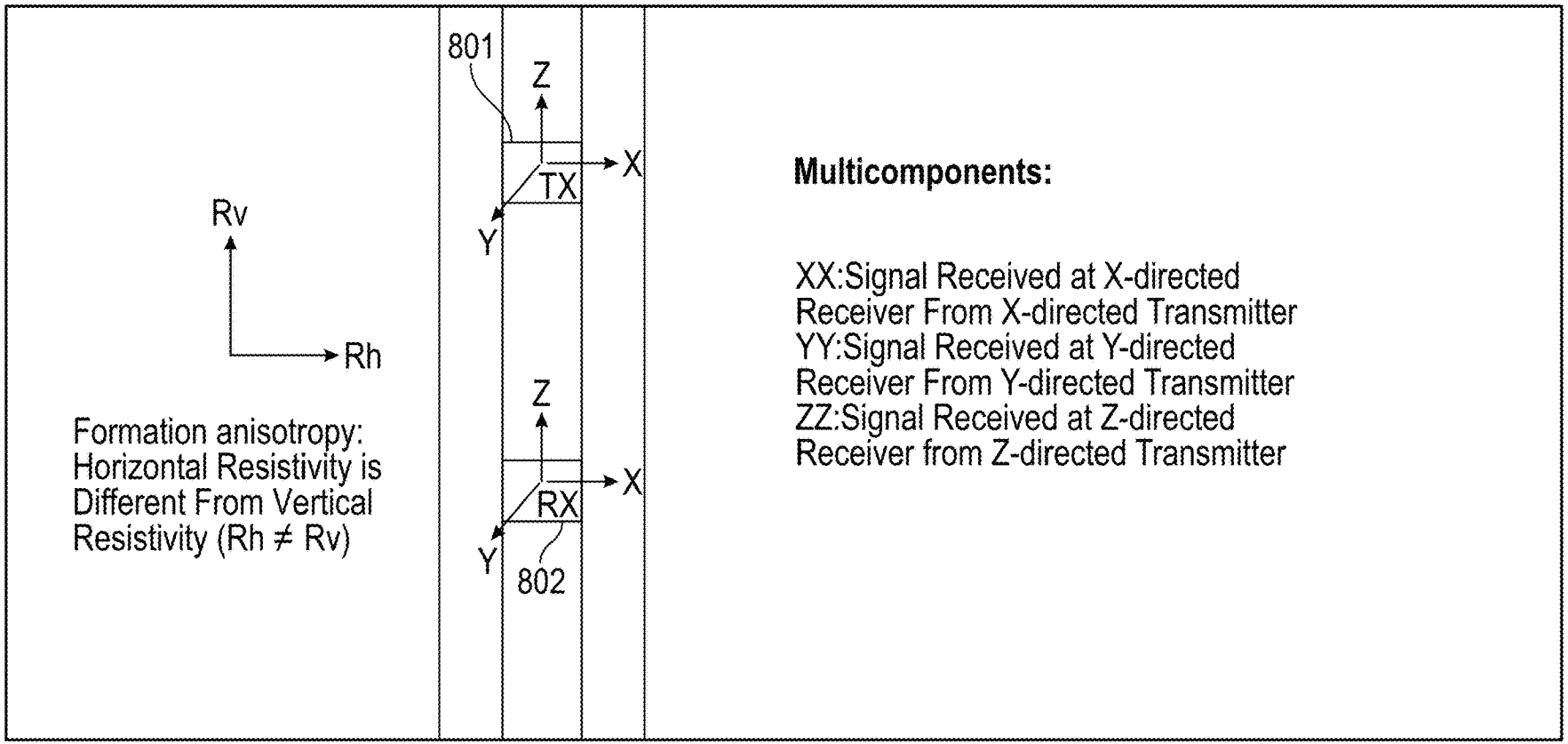
FIG. 8 illustrates a multicomponent induction (MCI) tool with tri-axial transmitter and tri-axial receiver is capable of providing multi-components.

FIG. 8 illustrates a multicomponent induction (MCI) tool with tri-axial transmitter and tri-axial receiver is capable of providing multi-components. The multicomponent induction (MCI) tool can provide multi-components (XX,YY,ZZ) using triaxial transmitter 801 and triaxial receiver 802. Borehole correction can also help to correct multicomponents and thereby improve the anisotropic resistivity results (Rh/Rv). The ultrasonic LWD caliper can also help in this more complex BHC process to simplify the inversion and enhance the robustness of the system. MCI provide multiple components (XX, YY, ZZ). ZZ can be used to invert Rt and/or OD, eccentricity. Further, XX/YY can be used to invert Rm. BHC can be applied to all components with Rt, OD, eccentricity, and Rm in a similar way as correcting Ra as previously discussed. The corrected multi-components will used to invert anisotropic resistivity Rh, Rv, and formation Dip. If there is no caliper data, we need to invert both Rt and OD and eccentricity from ZZ components, which adds ambiguity and complexity to the system. The inverted result has more uncertainty and less robust. Therefore, if the caliper data is available, we only need to invert Rt from ZZ. The result will be more accurate and reliable. However, high resolution caliper data is preferred to ensure an accurate Rt is obtained. The ultrasonic LWD caliper is able to provide high resolution caliper data in all drilling conditions and can help to reduce MCI inversion complexity and enhance BHC accuracy.

Figure 9:
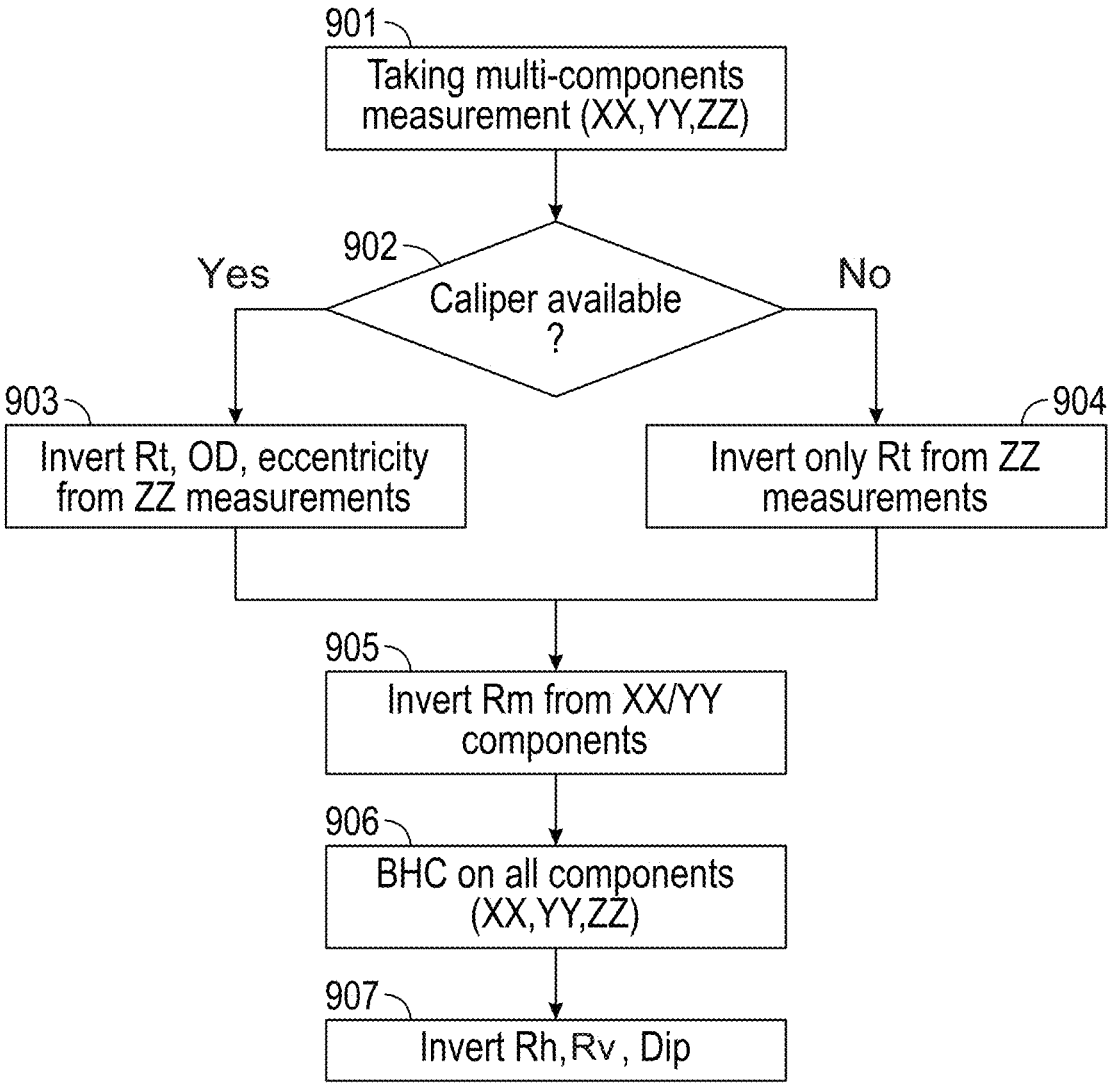
FIG. 9 illustrates a flowchart of an example method for determining a true resistivity of the formation using a multicomponent induction (MCI) tool.

FIG. 9 illustrates a flowchart of an example method for determining a true resistivity of the formation using a multicomponent induction (MCI) tool. At step 901, multicomponent measurements are made. Next, if caliper data is available (step 902), proceed to step 903; alternatively, if caliper data is not available (step 902), proceed to step 904. At step 903, the Rt, OD, and the eccentricity measured from the ZZ measurements are inverted. In these examples, the term "inverted" refers to reading or interpolating from database curves. Alternatively, at step 904, only Rt measured from the ZZ measurements is inverted. Next, at step 905, Rm is inverted from the measured XX/YY components. At step 906, BHC is performed on all components (XX, YY, and ZZ). And, finally, at step 907, Rh, Rv, and Dip are inverted to determine the true resistivity.

Figure 10:
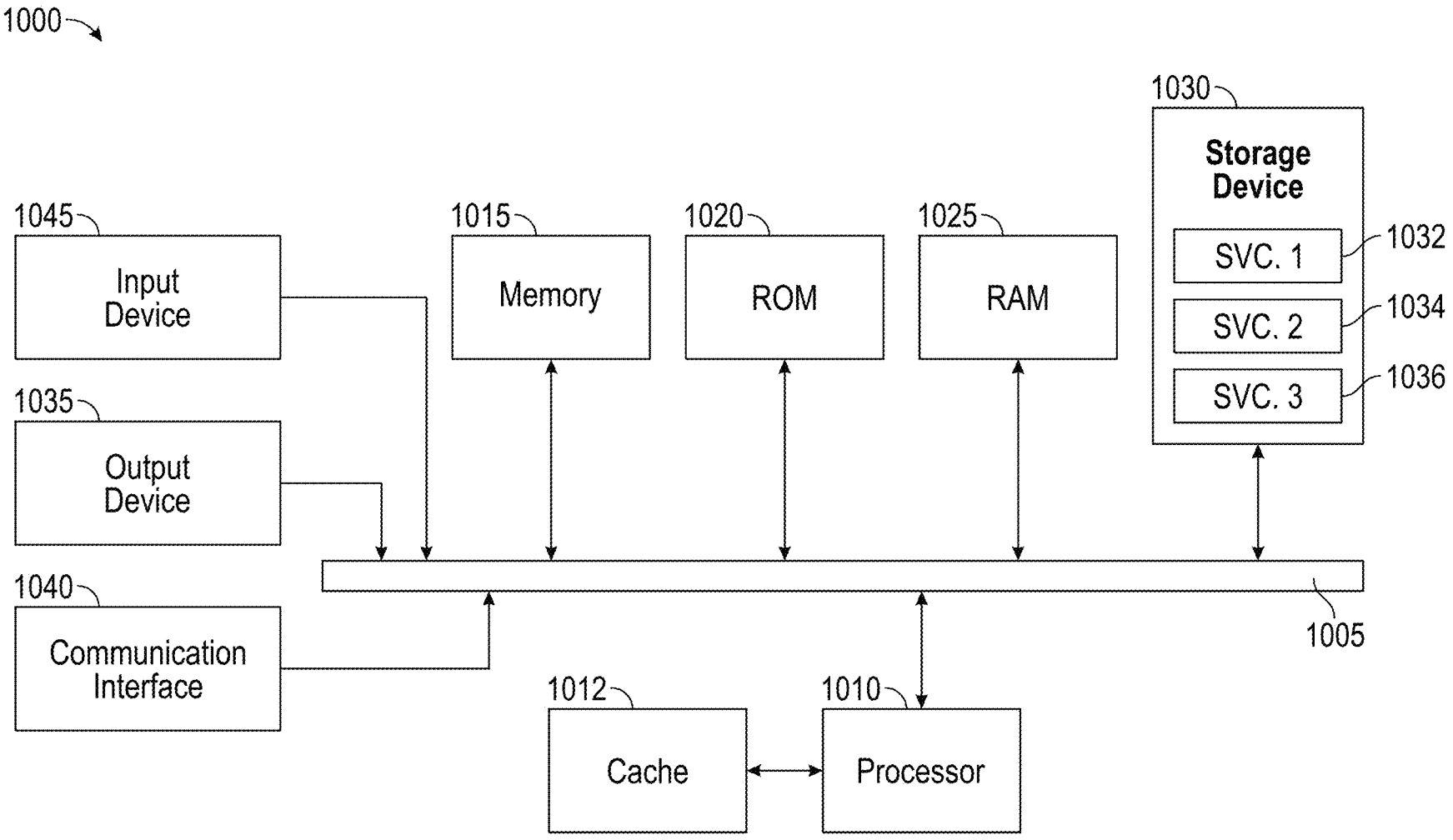
FIG. 10 illustrates an example computing device architecture which can be employed to perform various steps, methods, and techniques disclosed herein.

FIG. 10 illustrates an example computing device architecture 1000 which can be employed to perform various steps, methods, and techniques disclosed herein. Specifically, the computing device architecture can be integrated with the electromagnetic imager tools described herein. Further, the computing device can be configured to implement the techniques of controlling borehole image blending through machine learning described herein.

As noted above, FIG. 10 illustrates an example computing device architecture 1000 of a computing device which can implement the various technologies and techniques described herein. The components of the computing device architecture 1000 are shown in electrical communication with each other using a connection 1005, such as a bus. The example computing device architecture 1000 includes a processing unit (CPU or processor) 1010 and a computing device connection 1005 that couples various computing device components including the computing device memory 1015, such as read only memory (ROM) 1020 and random access memory (RAM) 1025, to the processor 1010.

The computing device architecture 1000 can include a cache of high-speed memory connected directly with, in close proximity to, or integrated as part of the processor 1010. The computing device architecture 1000 can copy data from the memory 1015 and/or the storage device 1030 to the cache 1012 for quick access by the processor 1010. In this way, the cache can provide a performance boost that avoids processor 1010 delays while waiting for data. These and other modules can control or be configured to control the processor 1010 to perform various actions. Other computing device memory 1015 may be available for use as well. The memory 1015 can include multiple different types of memory with different performance characteristics. The processor 1010 can include any general purpose processor and a hardware or software service, such as service 1 1032, service 2 1034, and service 3 1036 stored in storage device 1030, configured to control the processor 1010 as well as a special-purpose processor where software instructions are incorporated into the processor design. The processor 1010 may be a self-contained system, containing multiple cores or processors, a bus, memory controller, cache, etc. A multi-core processor may be symmetric or asymmetric.

To enable user interaction with the computing device architecture 1000, an input device 1045 can represent any number of input mechanisms, such as a microphone for speech, a touch-sensitive screen for gesture or graphical input, keyboard, mouse, motion input, speech and so forth. An output device 1035 can also be one or more of a number of output mechanisms known to those of skill in the art, such as a display, projector, television, speaker device, etc. In some instances, multimodal computing devices can enable a user to provide multiple types of input to communicate with the computing device architecture 1000. The communications interface 1040 can generally govern and manage the user input and computing device output. There is no restriction on operating on any particular hardware arrangement and therefore the basic features here may easily be substituted for improved hardware or firmware arrangements as they are developed.

Storage device 1030 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 1025, read only memory (ROM) 1020, and hybrids thereof. The storage device 1030 can include services 1032, 1034, 1036 for controlling the processor 1010. Other hardware or software modules are contemplated. The storage device 1030 can be connected to the computing device connection 1005. In one aspect, a hardware module that performs a particular function can include the software component stored in a computer-readable medium in connection with the necessary hardware components, such as the processor 1010, connection 1005, output device 1035, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Claim language or other language in the disclosure reciting "at least one of" a set and/or "one or more" of a set indicates that one member of the set or multiple members of the set (in any combination) satisfy the claim. For example, claim language reciting "at least one of A and B" or "at least one of A or B" means A, B, or A and B. In another example, claim language reciting "at least one of A, B, and C" or "at least one of A, B, or C" means A, B, C, or A and B, or A and C, or B and C, or A and B and C. The language "at least one of" a set and/or "one or more" of a set does not limit the set to the items listed in the set. For example, claim language reciting "at least one of A and B" or "at least one of A or B" can mean A, B, or A and B, and can additionally include items not listed in the set of A and B.

Statements of the Disclosure Include:

Aspect 1. A method comprising: accessing resistivity measurement data gathered by one or more resistivity sensors of a log while drilling ("LWD") tool during operation of the LWD tool in a borehole; identifying an apparent resistivity associated with a formation surrounding the borehole from the resistivity measurement data; selecting a model to apply from a plurality of models based on caliper measurement data, wherein the plurality of models specify relationships between an apparent resistivity variable, a borehole correction factor variable; applying the model to the apparent resistivity to identify a borehole correction factor; and determining a true resistivity of the formation by applying the borehole correction factor to the apparent resistivity.

Aspect 2. The method of Aspect 1, wherein the caliper measurement data includes data related to average borehole diameter of the borehole, eccentricity associated with the borehole, or a combination thereof.

Aspect 3. The method of Aspects 1 and 2, wherein the model is selected based, at least in part, on a known mud resistivity.

Aspect 4. The method of Aspects 1 through 3, wherein the caliper measurement data is gathered by one or more ultrasonic sensors of the LWD tool configured to operate in both an oil-based mud and a water-based mud.

Aspect 5. The method of Aspects 1 through 4, wherein the plurality of models include a multi-dimensional group of models for various borehole diameters, eccentricities, mud resistivities, or a combination thereof in relation to the borehole correction factor.

Aspect 6. The method of Aspects 1 through 5, wherein the resistivity measurement data includes multi-dimensional components obtained from a triaxial transmitter and a triaxial receiver, the method further comprising based on the inclusion of the caliper data in the measurement data: inverting the true resistivity obtained from a Z-directed signal received at the receiver from the transmitter transmitting in the Z-direction with the caliper measurement data; inverting a mud resistivity obtained from a X-directed signal received at the receiver from the transmitter transmitting in the X-direction and a Y-directed signal received at the receiver from the transmitter transmitting in the Y-direction; generating another set of models with inverted true resistivity, mud resistivity, borehole size, eccentricity, or a combination thereof to map between multi-dimensional components and their respective borehole correction factors; identifying an XX borehole correction factor based on the X-directed signal received at the receiver from the transmitter transmitting in the X-direction; identifying an YY borehole correction factor based on the Y-directed signal received at the receiver from the transmitter transmitting in the Y-direction; identifying an ZZ borehole correction factor based on the Z-directed signal received at the receiver from the transmitter transmitting in the Z-direction; applying borehole correction factors to obtain corrected directional components; and inverting at least one of an anisotropic resistivity associated with the formation, formation Dip associated with the formation, or a combination thereof based on the corrected directional components.

Aspect 7. The method of Aspect 6, wherein the corresponding the XX borehole correction factor, the YY borehole correction factor, and the ZZ borehole correction factor form the borehole correction factor.

Aspect 8. The method of Aspect 7, further comprising applying the corresponding borehole correction factor in each direction to a corresponding directional component to obtain the corrected directional components.

Aspect 9. The method of Aspects 1 through 5, wherein the borehole size and eccentricity are caliper data gathered from ultrasonic sensors.

Aspect 10. A system comprising: one or more processors; and at least one computer-readable storage medium having stored therein instructions which, when executed by the one or more processors, cause the one or more processors to: access resistivity measurement data gathered by one or more resistivity sensors of a log while drilling ("LWD") tool during operation of the LWD tool in a borehole; identify an apparent resistivity associated with a formation surrounding the borehole from the resistivity measurement data; select a model to apply from a plurality of models based on caliper measurement data, wherein the plurality of models specify relationships between an apparent resistivity variable, a borehole correction factor variable; apply the model to the apparent resistivity to identify a borehole correction factor; and determine a true resistivity of the formation by applying the borehole correction factor to the apparent resistivity.

Aspect 11. The system of Aspect 10, wherein the caliper measurement data includes data related to average borehole diameter of the borehole, eccentricity associated with the borehole, or a combination thereof.

Aspect 12. The system of Aspects 10 and 11, wherein the model is selected based, at least in part, on a known mud resistivity.

Aspect 13. The system of Aspects 10 through 12, wherein the caliper measurement data is gathered by one or more ultrasonic sensors of the LWD tool configured to operate in both an oil-based mud and a water-based mud.

Aspect 14. The system of Aspects 10 through 113, wherein the plurality of models include a multi-dimensional group of models for various borehole diameters, eccentricities, mud resistivities, or a combination thereof in relation to the borehole correction factor.

Aspect 15. The system of Aspects 10 through 14, wherein the resistivity measurement data includes multi-dimensional components obtained from a triaxial transmitter and a triaxial receiver, the method further comprising based on the inclusion of the caliper data in the measurement data: one or more processors; and at least one computer-readable storage medium having stored therein instructions which, when executed by the one or more processors, cause the one or more processors to: invert the true resistivity obtained from a Z-directed signal received at the receiver from the transmitter transmitting in the Z-direction with the caliper measurement data; invert a mud resistivity obtained from a X-directed signal received at the receiver from the transmitter transmitting in the X-direction and a Y-directed signal received at the receiver from the transmitter transmitting in the Y-direction; generate another set of models with inverted true resistivity, mud resistivity, borehole size, eccentricity, or a combination thereof to map between multi-dimensional components and their respective borehole correction factors; identify an XX borehole correction factor based on the X-directed signal received at the receiver from the transmitter transmitting in the X-direction; identify an YY borehole correction factor based on the Y-directed signal received at the receiver from the transmitter transmitting in the Y-direction; identify an ZZ borehole correction factor based on the Z-directed signal received at the receiver from the transmitter transmitting in the Z-direction; apply borehole correction factors to obtain corrected directional components; and invert at least one of an anisotropic resistivity associated with the formation, formation Dip associated with the formation, or a combination thereof based on the corrected directional components.

Aspect 16. The system of Aspect 15, wherein the corresponding the XX borehole correction factor, the YY borehole correction factor, and the ZZ borehole correction factor form the borehole correction factor.

Aspect 17. A non-transitory computer-readable medium having instructions stored thereon that, when executed by at least one processor, cause the at least one processor to perform operations comprising: accessing resistivity measurement data gathered by one or more resistivity sensors of a log while drilling ("LWD") tool during operation of the LWD tool in a borehole; identifying an apparent resistivity associated with a formation surrounding the borehole from the resistivity measurement data; selecting a model to apply from a plurality of models based on caliper measurement data, wherein the plurality of models specify relationships between an apparent resistivity variable, a borehole correction factor variable; applying the model to the apparent resistivity to identify a borehole correction factor; and determining a true resistivity of the formation by applying the borehole correction factor to the apparent resistivity.

Aspect 18. The non-transitory computer-readable medium of Aspect 17, wherein the caliper measurement data includes data related to average borehole diameter of the borehole, eccentricity associated with the borehole, or a combination thereof.

Aspect 19. The non-transitory computer-readable medium of Aspects 17 and 18, wherein the model is selected based, at least in part, on a known mud resistivity.

Aspect 20. The non-transitory computer-readable medium of Aspects 17 through 19, wherein the caliper measurement data is gathered by one or more ultrasonic sensors of the LWD tool configured to operate in both an oil-based mud and a water-based mud.

Aspect 21. A system comprising means for performing a method according to any of Aspects 1 through 8.

What is claimed is:

1. A method comprising:

accessing resistivity measurement data gathered by one or more resistivity sensors of a log while drilling ("LWD") tool during operation of the LWD tool in a borehole;

identifying an apparent resistivity associated with a formation surrounding the borehole from the resistivity measurement data;

selecting a model from a plurality of models based on ultrasonic caliper measurement data, wherein the plurality of models specify relationships between an apparent resistivity variable and a borehole correction factor variable;

applying the model to the apparent resistivity to identify a borehole correction factor based on the ratio between the apparent resistivity and a true resistivity;

determining the true resistivity of the formation by applying the borehole correction factor to the apparent resistivity; and geosteering the LWD tool based on the determined true resistivity of the formation by rotating a drill bit through a subterranean formation.

2. The method of claim 1, wherein the caliper measurement data includes data related to average borehole diameter of the borehole, eccentricity associated with the borehole, or a combination of the diameter and the eccentricity.

3. The method of claim 1, wherein the model is selected based, at least in part, on a known mud resistivity.

4. The method of claim 1, wherein the caliper measurement data is gathered by one or more ultrasonic sensors of the LWD tool configured to operate in both an oil-based mud and a water-based mud.

5. The method of claim 1, wherein the plurality of models include a multi-dimensional group of models for various borehole diameters, eccentricities, mud resistivities, or a combination of the diameter and the eccentricity in relation to the borehole correction factor.

6. The method of claim 1, wherein the resistivity measurement data includes multi-dimensional components obtained from a triaxial transmitter and a triaxial receiver, the method further comprising based on the inclusion of the caliper data in the measurement data:

inverting the true resistivity obtained from a Z-directed signal received at the receiver from the transmitter transmitting in the Z-direction with the caliper measurement data;

inverting a mud resistivity obtained from a X-directed signal received at the receiver from the transmitter transmitting in the X-direction and a Y-directed signal received at the receiver from the transmitter transmitting in the Y-direction;

generating another set of models with inverted true resistivity, mud resistivity, borehole size, eccentricity, or a combination of the true resistivity, the mud resistivity, the borehole size and the eccentricity to map between multi-dimensional components and their respective borehole correction factors;

identifying an XX borehole correction factor based on the X-directed signal received at the receiver from the transmitter transmitting in the X-direction;

identifying an YY borehole correction factor based on the Y-directed signal received at the receiver from the transmitter transmitting in the Y-direction;

identifying an ZZ borehole correction factor based on the Z-directed signal received at the receiver from the transmitter transmitting in the Z-direction;

applying borehole correction factors to obtain corrected directional components; and inverting at least one of an anisotropic resistivity associated with the formation, formation Dip associated with the formation, or a combination of the formation and the Dip based on the corrected directional components.

7. The method of claim 6, wherein the corresponding the XX borehole correction factor, the YY borehole correction factor, and the ZZ borehole correction factor form the borehole correction factor.

8. The method of claim 7, further comprising applying the corresponding borehole correction factor in each direction to a corresponding directional component to obtain the corrected directional components.

9. The method of claim 6, wherein the borehole size and eccentricity are caliper data gathered from ultrasonic sensors.

10. A system comprising:

one or more processors; and at least one computer-readable storage medium having stored therein instructions which, when executed by the one or more processors, cause the one or more processors to:

access resistivity measurement data gathered by one or more resistivity sensors of a log while drilling ("LWD") tool during operation of the LWD tool in a borehole;

identify an apparent resistivity associated with a formation surrounding the borehole from the resistivity measurement data;

select a model from a plurality of models based on ultrasonic caliper measurement data, wherein the plurality of models specify relationships between an apparent resistivity variable and a borehole correction factor variable;

apply the model to the apparent resistivity to identify a borehole correction factor based on the ratio between the apparent resistivity and a true resistivity;

determine the true resistivity of the formation by applying the borehole correction factor to the apparent resistivity; and geosteer the LWD tool based on the determined true resistivity of the formation by rotating a drill bit through a subterranean formation.

11. The system of claim 10, wherein the caliper measurement data includes data related to average borehole diameter of the borehole, eccentricity associated with the borehole, or a combination of the diameter and the eccentricity.

12. The system of claim 10, wherein the model is selected based, at least in part, on a known mud resistivity.

13. The system of claim 10, wherein the caliper measurement data is gathered by one or more ultrasonic sensors of the LWD tool configured to operate in both an oil-based mud and a water-based mud.

14. The system of claim 10, wherein the plurality of models include a multi-dimensional group of models for various borehole diameters, eccentricities, mud resistivities, or a combination of the diameter and the eccentricity in relation to the borehole correction factor.

15. The system of claim 10, wherein the resistivity measurement data includes multi-dimensional components obtained from a triaxial transmitter and a triaxial receiver, the method further comprising based on the inclusion of the caliper data in the measurement data:

one or more processors; and at least one computer-readable storage medium having stored therein instructions which, when executed by the one or more processors, cause the one or more processors to:

invert the true resistivity obtained from a Z-directed signal received at the receiver from the transmitter transmitting in the Z-direction with the caliper measurement data;

invert a mud resistivity obtained from a X-directed signal received at the receiver from the transmitter transmitting in the X-direction and a Y-directed signal received at the receiver from the transmitter transmitting in the Y-direction;

generate another set of models with inverted true resistivity, mud resistivity, borehole size, eccentricity, or a combination of the true resistivity, the mud resistivity, the borehole size and the eccentricity to map between multi-dimensional components and their respective borehole correction factors;

identify an XX borehole correction factor based on the X-directed signal received at the receiver from the transmitter transmitting in the X-direction;

identify an YY borehole correction factor based on the Y-directed signal received at the receiver from the transmitter transmitting in the Y-direction;

identify an ZZ borehole correction factor based on the Z-directed signal received at the receiver from the transmitter transmitting in the Z-direction;

apply borehole correction factors to obtain corrected directional components; and invert at least one of an anisotropic resistivity associated with the formation, formation Dip associated with the formation, or a combination of the formation and the Dip based on the corrected directional components.

16. The system of claim 15, wherein the corresponding the XX borehole correction factor, the YY borehole correction factor, and the ZZ borehole correction factor form the borehole correction factor.

17. A non-transitory computer-readable medium having instructions stored thereon that, when executed by at least one processor, cause the at least one processor to perform operations comprising:

accessing resistivity measurement data gathered by one or more resistivity sensors of a log while drilling ("LWD") tool during operation of the LWD tool in a borehole;

identifying an apparent resistivity associated with a formation surrounding the borehole from the resistivity measurement data;

selecting a model from a plurality of models based on ultrasonic caliper measurement data, wherein the plurality of models specify relationships between an apparent resistivity variable and a borehole correction factor variable;

applying the model to the apparent resistivity to identify a borehole correction factor based on the ratio between the apparent resistivity and a true resistivity;

determining the true resistivity of the formation by applying the borehole correction factor to the apparent resistivity; and geosteering the LWD tool based on the determined true resistivity of the formation by rotating a drill bit through a subterranean formation.

18. The non-transitory computer-readable medium of claim 17, wherein the caliper measurement data includes data related to average borehole diameter of the borehole, eccentricity associated with the borehole, or a combination of the diameter and the eccentricity.

19. The non-transitory computer-readable medium of claim 17, wherein the model is selected based, at least in part, on a known mud resistivity.

20. The non-transitory computer-readable medium of claim 17, wherein the caliper measurement data is gathered by one or more ultrasonic sensors of the LWD tool configured to operate in both an oil-based mud and a water-based mud.

* * * * *